United States Patent [19]

Zimmermann

[11] 4,178,502

[45] Dec. 11, 1979

[54] ARRANGEMENT FOR COUNTING COINS OF DIFFERENT DIAMETERS

[75] Inventor: Thomas Zimmermann, Berlin, Fed. Rep. of Germany

[73] Assignee: F. Zimmermann & Co., Berlin, Fed. Rep. of Germany

[21] Appl. No.: 888,663

[22] Filed: Mar. 21, 1978

[30] Foreign Application Priority Data

Mar. 26, 1977 [DE] Fed. Rep. of Germany ..... 2713844

[51] Int. Cl.[2] ..... G07D 9/00

[52] U.S. Cl. ..... 235/92 CN; 133/8 R

[58] Field of Search ..... 235/92 CN, 92 PK, 92 DN, 235/98 A; 133/8 R, 4 A

[56] References Cited

U.S. PATENT DOCUMENTS

| | | | |
|---|---|---|---|
| 2,540,063 | 1/1951 | Victoreen | 235/98 A |
| 3,153,727 | 10/1964 | Nathan | 235/92 DN |
| 3,159,749 | 12/1964 | Dalrymple et al. | 235/92 DN |
| 3,197,620 | 7/1965 | Peltier | 235/92 PK |
| 3,692,980 | 9/1972 | Getker et al. | 235/92 PK |
| 3,699,981 | 10/1972 | Conant et al. | 235/92 CN |
| 3,939,954 | 2/1976 | Collins | 133/8 R |
| 4,082,099 | 4/1978 | Iwerson | 133/8 R |

*Primary Examiner*—Joseph M. Thesz
*Attorney, Agent, or Firm*—Max Fogiel

[57] ABSTRACT

A device for counting coins of different diameters and similar disk-shaped objects which are conveyed in irregular sequence. The edges of the coins contact a guide edge on a guide track which has a scanning head located therein for identifying the coins. An electronic evaluation and display unit receives the identification signals delivered by the scanning head. The scanning head has several electronic proximity sensors located at different distances from the guide edge. The paths of motion of the edges of coins away from the guide edge, run in the active areas of the proximity sensors which provide substantially clear identification signals distinguishing the coins to be identified. The diameter of the proximity sensors is approximately half the diameter of the smallest coin to be identified, and the several proximity sensors are located at different distances from the guide edge. These distances are determined by the paths of motion of different coins. The sensors, furthermore, may be staggered along a line perpendicular to the guide edge. The electronic proximity sensors, moreover, may be located one behind another in the direction of motion of the coins.

9 Claims, 6 Drawing Figures

32,8
28
22,8
21
3
11
13
15
1,5
6
5
16
14
22
17
7
8
6
18
19
20

14
15
24
13

18
19
20
17
16
14
22
15
13
23

15
14
13
25

ARRANGEMENT FOR COUNTING COINS OF DIFFERENT DIAMETERS

BACKGROUND OF THE INVENTION

The present invention relates to a device for counting coins of different diameters and similar disk-shaped objects which are conveyed in irregular sequence, with their edge contacting a guide edge, on a guide track. A scanning head is located in the guide track for identifying the coins, and an electronic evaluation and display device is provided for the identification signals delivered by the scanning head.

It is already known how to measure coins of different diameters and similar disk-shaped objects along a sorting section with graduated drop-out openings, in which the coins are sorted and the coins sorted by size are counted. There are also known counters equipped with scanners which are located as scanning heads at the drop-out locations for the coins and provide counting pulses. The number of scanning heads depends on the number of coin sizes which have to be counted. The value-wise counting of all coins of the various sizes is accomplished by adding up the coins counted in the various denominations. Such a known device operates relatively slowly, and the more counting locations, the greater is the possibility of error in counting.

For a device of the above type, there is known a single scanning head located ahead of the sorting sections; this head comprises an iron core with a scanning air gap through which the coins are passed and a comparison (standard) air gap. With this known scanning head the coins pass through a magnetic alternating measurement field and are scanned inductively in relation to the guide edge. They are identified by value, since every coin when passing through the magnetic field via its diameter triggers a series of pulses corresponding to its value. The successive series of pulses are added by the evaluating device and the total value of all coins is displayed digitally by the display device.

This known scanning head does not operate perfectly for the conventional coins since the measuring result of the scanning head greatly depends on the coin material. Conventional coins, even of the same denomination, have different alloying components so that even when the same denomination passes the scanning head, different identification signals are given, falsifying the result. In addition, the known scanning head, based on its construction of an iron core with scanning and comparison air gap, is expensive to manufacture and requires an expensive electronic evaluation device.

It is, therefore, an object of the present invention to provide a device of the above type which is simple in construction and delivers the same identification signals for the same coin denomination regardless of its alloying components.

Another object of the present invention is to provide an arrangement of the foregoing character which has a construction arranged to be economically fabricated.

A further object of the present invention is to provide an arrangement, as described, which may be readily maintained in service and which has a substantially long operating life.

SUMMARY OF THE INVENTION

The objects of the present invention are achieved by providing that the scanning head is composed of at least one electronic proximity sensor located at a distance from the guide edge. The path of motion of the coin edge away from the guide edge runs in the vicinity of the active surface of the proximity sensor. Such a device, by using commercial electronic proximity sensors, is simple in construction, it requires neither a scanning air gap nor a comparison air gap. By placing the electronic proximity sensor with its active surface in the vicinity of the path of motion of the coin edge away from the guide edge, the identification signal delivered by the electronic proximity sensor to the evaluating device for the same coin denomination is always the same and essentially independent of the material properties or alloying components of the coin. The identification signal is solely determined by the path of motion of the coin edge away from the guide edge of coins to be identified by a proximity sensor. This path of motion always remains the same for all coins of the same denomination so that identical identification signals are obtained for identical coin denominations. This surprising effect, which occurs when using commercial electronic proximity sensors is broadened by the fact that with a single electronic proximity sensor, several different paths of motion of different coin diameters can be scanned, producing clearly distinguishable identification signals.

In the preferred embodiment of the invention, the diameter of the proximity sensor is about half the diameter of the smallest coin to be identified, and several electronic proximity sensors, constituting the scanning head, are provided at different distances from the guide edge; these distances are determined by the paths of motion of different coin denominations.Several electronic proximity sensors may be staggered along a line perpendicular to the guide edge or one behind the other in the direction of motion of the coins. With these embodiments, the identification signal is the measured value, delivered by the proximity sensor, which immediately follows a decrease of the measured value.

Another embodiment of the present invention provides for an additional proximity sensor for delivering a signal for the instant of measurement of the identification signal by the evaluating device. With this embodiment, the identification signal is that measured value of the proximity sensors present at the instant of signal delivery by the additional proximity sensor. The additional proximity sensor may be located either immediately next to the guide edge in the direction of motion of the coins in line with the other proximity sensors or in the direction of motion behind the other proximity sensors.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
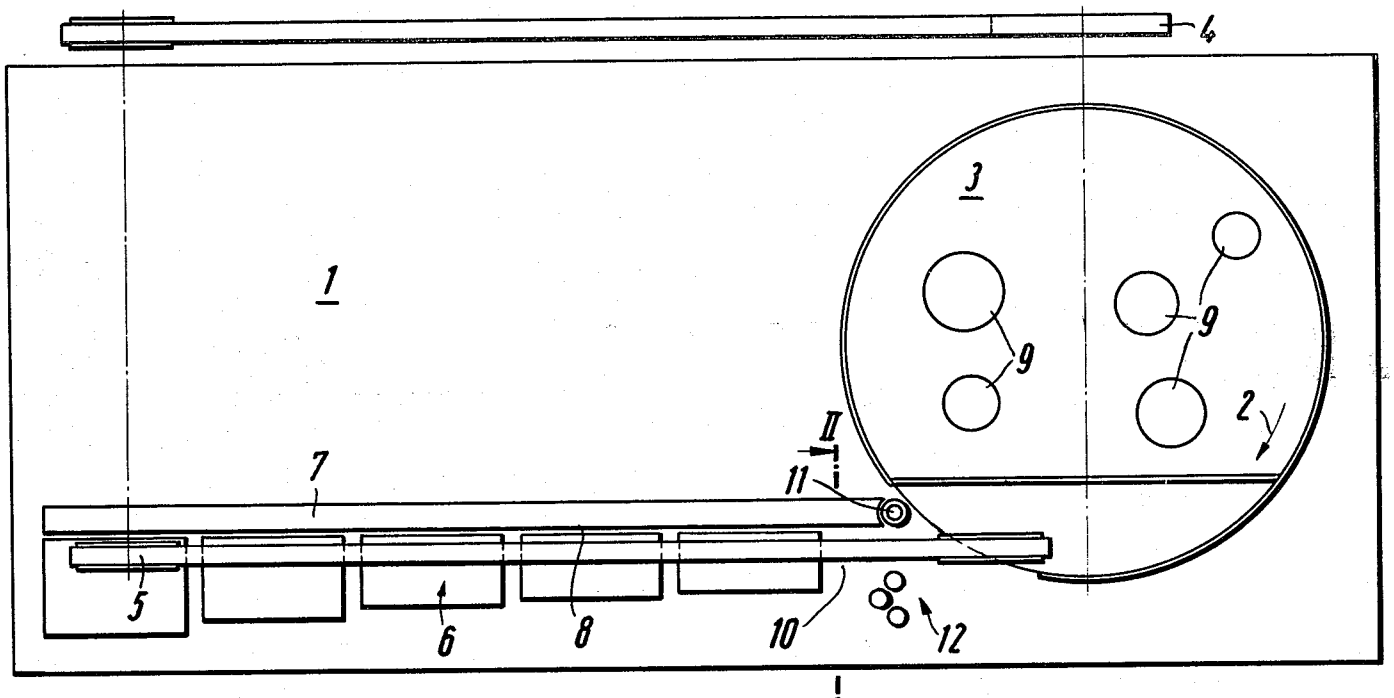
FIG. 1 shows a simplified top view of a device for counting coins of different diameters.

The device for counting coins of different diameters comprises a frame with a cover plate 1, a centrifugal plate 3 driven to rotate in the direction of arrow 3, an endless conveyor belt 5 located above cover plate 1 with a belt drive 4, a sorting section 6 with dropout openings of different dimensions and a guide rail 7 which constitutes a guide edge 8 for contacting the coins 9 to be moved and counted. The coins 9 are moved individually from the centrifugal plate to a guide track 10 located underneath the conveyor belt 5; this guide track is the surface of cover plate 1. During this process, the coins 9 due to the action of conveyor belt 5, make close contact with the guide edge 8 after the coins 9 have passed a rotary guide wheel 11.

Figure 2:
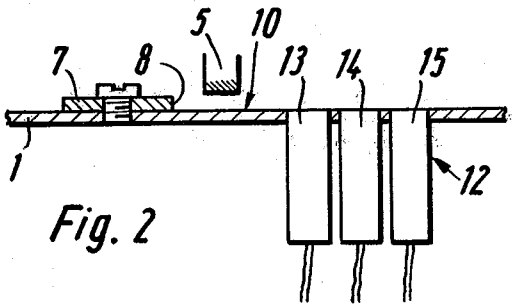
FIG. 2 shows a simplified section taken along line II—II in FIG. 1.

In the vicinity of guide wheel 11, a scanning head 12 is mounted in the guide track 10; this scanning head identifies the coins 9 and is connected to an electronic evaluation and indication apparatus in an unspecified manner, for the identification signals provided by the scanning head 12. The scanning head 12 comprises at least one, and in FIGS. 1 and 2, three electronic proximity sensors 13, 14, 15 whose active surface is mounted flush with the surface of cover plate 1 (in FIG. 2, the electronic proximity sensors 13, 14, 15 for the sake of simplicity are shown one behind the other, even though according to the top view of FIG. 1 they are staggered and partially overlap).

Figure 3:
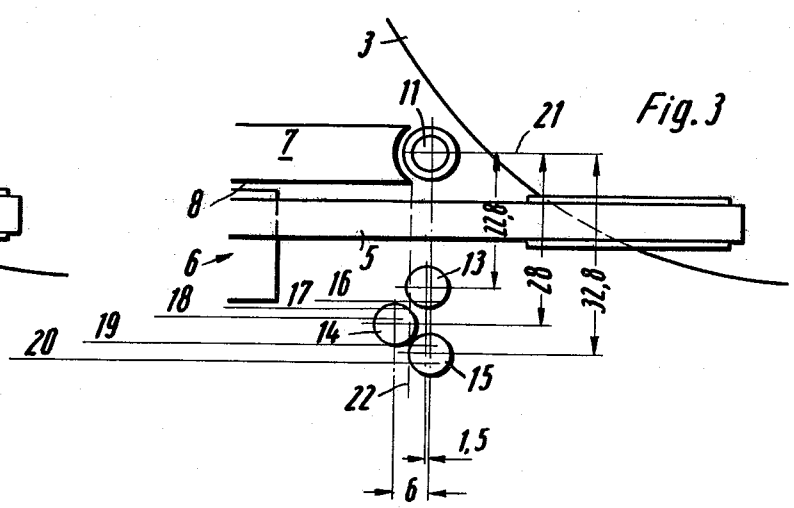
FIGS. 3 to 6 show simplified views of various embodiments of a scanning head of several electronic proximity sensors in accordance with the present invention.

The proximity sensors 13, 14, 15 are located at a distance from the guide edge 8, with the paths of motion 16, 17, 18, 19, 20 of the edge, away from the guide edge 8, of the coins 9 to be identified by the proximity sensors, running in the vicinity of the active surfaces of the proximity sensors (FIG. 3). Path of motion 16 may correspond to a 0.50 DM coin, path of motion 17 may correspond to a 0.10 DM coin, path of motion 18 may correspond to a 1.00 DM coin, path of motion 19 may correspond to a 2.00 DM coin and path of motion 20 may correspond to a 5.00 coin. (The symbol DM corresponds to German currency, for example). With other monetary systems, similar paths of motion are used. Thus a proximity sensors can provide identification signals for several paths of motion of different coins. FIG. 3 shows the spacing dimensions of the various proximity sensors 13, 14, 15 from a reference line 21 and from one another for a preferred embodiment.

FIG. 3 shows that the diameter of the proximity sensors 13, 14, 15 equals about half the diameter of the smallest coin to be identified, and that several proximity sensors 13, 14, 15 forming the scanning head are arranged at different spacings, determined by the paths of motion of 16–20 different coins 9, from the guide edge 8. The electronic proximity sensors 13, 14, 15 are arranged in a staggered manner along an imaginary line 22 perpendicular to the guide edge.

Figure 4:
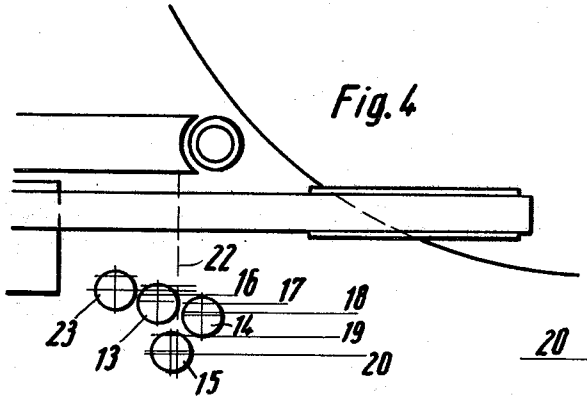

In the embodiment of FIG. 4, the proximity sensors 13, 14, 15 are again located along the imaginary line 22 perpendicular to the guide edge, but re-arranged. Their distance from the guide edge 8 has remained nearly the same, since the same paths of motion 16–20 are to be covered. Here the proximity sensor 13 can identify, in addition to the 0.50 DM coins, the 0.20 and 0.05 DM coins also. In addition, a proximity sensor 23 is located in the direction of motion behind the three proximity sensor 13, 14, 15; this sensor has a smaller distance from the guide edge 8 and is used to identify the smallest German coin, the 0.01 DM coin.

With the above-described arrangements of electronic proximity sensor 13, 14, 15, the identification signals are measured by the electronic evaluating device if there is a decrease of a maximum value of an identification signal. For example, the identification signal is received by the proximity sensor 13 for the 0.50 DM coin when the highest delivered identification signal value is exceeded and the signal value decreases. The 5.00 DM coin is identified when the maximum identification signal delivered by the proximity sensor 15 starts to decrease from its maximum value. The identification signals of the other proximity sensors 13, 14 remain at their maximum values and decrease only when the identification process has already been completed.

Figure 6:
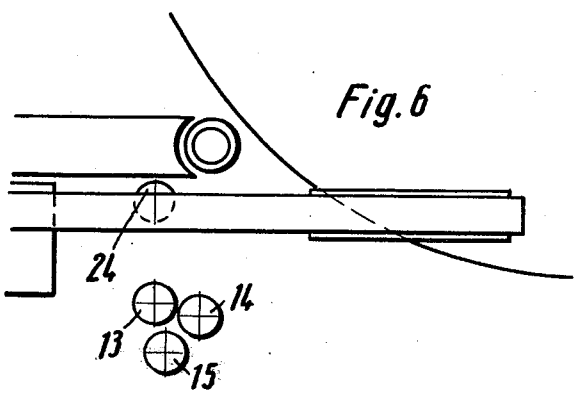
Figure 5:
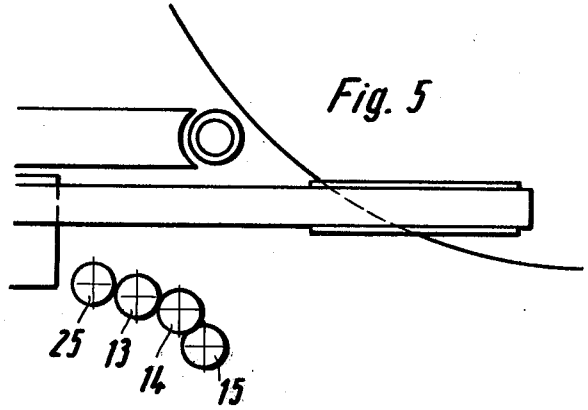

In the embodiments according to FIGS. 5 and 6, there is an additional proximity sensor 24 or 25, respectively, which is used to provide a signal for the instant of measurement of the identification signal by the evaluating device. The additional proximity sensor 24 in the embodiment of FIG. 6 is located immediately next to the guide edge 8 in the direction of motion of the coins 9 in line with the other proximity sensors. The additional proximity sensor 25 in the embodiment of FIG. 5 is located in the direction of motion behind the other proximity sensors. Measurement of the identification signals by the evaluating device takes place for these two embodiments only when the additional proximity sensors 24, 25 have provided an additional indication pulse for measuring the identification signals.

In FIG. 5, the proximity sensors 15, 14, 13 are arranged one after the other in the direction of motion of coins 9, with the additional proximity sensor 25 located behind them in the direction of motion.

For the preferred embodiment, proximity sensors 921 FS1 by Honeywell were used; their diameter is about 7 mm while the diameter of the smallest German coin, the 0.01 coin, is 17 mm. The electronic proximity sensors deliver an analog linear output signal proportional to the coverage by the coins; this signal may extend over the entire area of the active surface or only part of this surface. The different coverage produces different voltage signals which are compared in the evaluating device with predetermined values by means of comparators and are then displayed (or indicated). It is important for an accurate measurement that the identification takes place within a narrow range perpendicular to the guide edge before the coins are sorted, so that the coin flow may also be interrupted, with the interruption being possible immediately after identifying the last coin passing the scanning head.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What I claim:

1. An arrangement for counting coins of different diameters and similar disk-shaped objects conveyed in irregular sequence, comprising: guide track means with guide edge for contacting the edge of said coins; a plurality of electronic proximity sensors located in said guide track means for identifying said coins and delivering identification signals; electronic evaluation and display means for receiving identification signals delivered by said proximity sensors; said electronic proximity sensors being offset along a line perpendicular to said guide edge at a distance from said guide edge such that paths of motions of coin edges away from said guide edge of several coins to be identified by one of said proximity sensors are located in active areas of said proximity sensors; said proximity sensors being capable of emitting analog linear identification signals proportional to coverage of said active areas of said proximity sensors by coins in transit, said coverage being determined by said paths of motion; the number of proximity sensors being minimum for a maximum number of coins of different diameter to be identified and their values totaled.

2. An arrangement as defined in claim 1 wherein said proximity sensors have a diameter corresponding substantially to half the diameter of the smallest coin to be identified, said plurality of sensors being located at different distances from said guide edge, said distances being dependent on said paths of motion of different coins.

3. An arrangement as defined in claim 2 wherein said proximity sensors are staggered along a line perpendicular to said guide edge.

4. An arrangement as defined in claim 2 wherein said proximity sensors are located one behind another in direction of motion of said coins.

5. An arrangement as defined in claim 1 including an auxiliary proximity sensor for generating a signal corresponding to an instant of measurement of said identification signals by said evaluation and display means.

6. An arrangement as defined in claim 5 including an auxiliary proximity sensor located immediately adjacent to said guide track means in direction of motion of said coins in line with said plurality of proximity sensors.

7. An arrangement as defined in claim 5 including an auxiliary proximity sensor located in direction of motion behind said plurality of proximity sensors.

8. An arrangement as defined in claim 1 including conveyor belt means for maintaining said coins in contact with said guide edge.

9. An arrangement as defined in claim 1 including conveyor belt means for maintaining said coins in contact with said guide edge; said proximity sensors having a diameter corresponding substantially to half the diameter of the smallest coin to be identified, said plurality of sensors being located at different distances from said guide edge, said distances being dependent on said paths of motion of different coins; said proximity sensors being located one behind another in direction of motion of said coins; an auxiliary proximity sensor for generating a signal corresponding to an instant of measurement of said identification signals by said evaluation and display means; and an auxiliary proximity sensor located immediately adjacent to said guide track means in direction of motion of said coins in line with said plurality of proximity sensors.

* * * * *